US009269337B2

(12) United States Patent
Sato et al.

(10) Patent No.: US 9,269,337 B2
(45) Date of Patent: Feb. 23, 2016

(54) DRUM MOUNTING DEVICE AND DRUM

(71) Applicant: HOSHINO GAKKI CO., LTD., Nagoya, Aichi (JP)

(72) Inventors: Naoki Sato, Nagoya (JP); Hideyuki Miyajima, Nagoya (JP)

(73) Assignee: HOSHINO GAKKI CO., LTD., Nagoya (JP)

( * ) Notice: Subject to any disclaimer, the term of this patent is extended or adjusted under 35 U.S.C. 154(b) by 209 days.

(21) Appl. No.: 13/689,630

(22) Filed: Nov. 29, 2012

(65) Prior Publication Data

US 2014/0026736 A1 Jan. 30, 2014

(30) Foreign Application Priority Data

Jul. 24, 2012 (JP) ..... 2012-163777

(51) Int. Cl.
*G10D 13/02* (2006.01)

(52) U.S. Cl.
CPC ..... *G10D 13/026* (2013.01)

(58) Field of Classification Search
USPC ..... 84/421
See application file for complete search history.

(56) References Cited

U.S. PATENT DOCUMENTS

| | | | | |
|---|---|---|---|---|
| 5,309,811 | A | 5/1994 | Hoshino | |
| 5,454,288 | A | 10/1995 | Hoshino | |
| 5,507,584 | A * | 4/1996 | Sassmannshausen et al. | 403/78 |
| 5,600,080 | A * | 2/1997 | Belli | 84/421 |
| 5,660,364 | A * | 8/1997 | Hsieh | 248/309.1 |
| 6,008,445 | A * | 12/1999 | Chen | G10D 13/025 84/402 |
| 6,307,135 | B1 * | 10/2001 | Hoshino | 84/421 |
| 6,846,978 | B2 * | 1/2005 | Dorfman | G10D 13/025 84/411 R |
| 7,795,518 | B2 * | 9/2010 | Yoshino | G10D 13/024 84/104 |
| 7,943,840 | B2 * | 5/2011 | Yoshino et al. | 84/421 |
| 8,242,343 | B2 | 8/2012 | Jones et al. | |
| 8,399,755 | B2 * | 3/2013 | Wang | 84/421 |
| 2011/0030531 | A1 * | 2/2011 | Nakata et al. | 84/421 |
| 2011/0126693 | A1 * | 6/2011 | Reyes | 84/421 |

FOREIGN PATENT DOCUMENTS

| | | |
|---|---|---|
| JP | 06-311952 A | 11/1994 |
| JP | 07-210154 A | 8/1995 |
| JP | 2007-225054 A | 9/2007 |

OTHER PUBLICATIONS

Japanese Office Action dated Jun. 10, 2014 issued in Japanese Patent Application No. 2012-163777.

* cited by examiner

*Primary Examiner* — Christopher Uhlir

(57) ABSTRACT

A floor tom-tom is mounted on three floor tom-tom legs via three tom-tom mounting devices. Each tom-tom mounting device is composed of a memory lock and a floor tom-tom bracket located on the memory lock. The tom-tom mounting device is configured to be capable of fixing the floor tom-tom bracket to the memory lock.

9 Claims, 11 Drawing Sheets

DRUM MOUNTING DEVICE AND DRUM

BACKGROUND OF THE INVENTION

The present invention relates to a drum mounting device for attaching a drum, such as a tom-tom, to a bass drum, a stand or the like. The present invention also pertains to a drum.

For setting up a tom-tom, a tom-tom holder attached to a bass drum or a cymbal stand, a dedicated tom-tom stand or the like is generally used. As a tom-tom bracket applied to such a tom-tom holder or a tom-tom stand, ones such as described below have been proposed.

A tom-tom bracket 100 shown in FIG. 14 is composed of a bracket body 101 and a memory lock 102. The bracket body 101 is fixed to a shell of a floor tom-tom FT, and the memory lock 102 is fixed to a rod R constituting a floor tom-tom leg. To use the tom-tom bracket 100, first, the memory lock 102 is fixed to the rod R with a bolt 103 and a nut 104 or the like. Next, using the bolt 105 and the nut 106 or the like, the tom-tom bracket 100 is attached at a predetermined position on the rod R to which the memory lock 102 has been fixed. Accordingly, the floor tom-tom FT is attached to a plurality of floor tom-tom legs, and set up on a floor surface. The memory lock 102 is for making the rod R memorize the mounting position of the floor tom-tom FT. That is, by fixing the memory lock 102 to the rod R, the rod R can be made to memorize the mounting position of the floor tom-tom FT when the floor tom-tom FT which has been detached from the floor tom-tom legs in order to store the floor tom-tom FT is reattached to the floor tom-tom legs again, so that the setting of the floor tom-tom FT can be quickly completed.

Further, as shown in FIG. 15, the specification of U.S. Pat. No. 5,309,811 discloses a tom-tom bracket 110 provided with a memory lock function. The tom-tom bracket 110 is provided with a support plate 111, and hooks 112 and 113 located at upper and lower ends of the support plate 111. To use the tom-tom bracket 110, first, the tom-tom bracket 110 is fixed to an L-shaped rod LR protruding from a tom-tom holder fixed to a bass drum (not shown). Next, a tom-tom T is attached to the tom-tom bracket 110 by hooking the hooks 112 and 113 on an upper hoop UF and a lower hoop LF of the tom-tom T, respectively. Thus, the tom-tom T is attached to the L-shaped rod LR, and mounted on the bass drum.

According to the tom-tom bracket 100 shown in FIG. 14, however, in order to adjust the height of the floor tom-tom FT in relation to the rod R, the following work is required. First, the bolt 103 screwed on the nut 104 is loosened so that the memory lock 102 is movable on the rod R. Next, the nut 106 screwed on the bolt 105 is loosened so that the bracket body 101 is movable on the rod R. Then, after the bracket body 101 is moved and the height of the floor tom-tom FT is determined, the bracket body 101 is fixed to the rod R by tightening the nut 106 to the bolt 105. Then, after the memory lock 102 is arranged in the fixed position of the bracket body 101, the memory lock 102 is fixed to the rod R by tightening the bolt 103 to the nut 104. Such work is troublesome and laborious for a user, since tightening and loosening the bolt 103, the nut 106, and the like is repeated many times.

Further, according to the tom-tom bracket 110 shown in FIG. 15, the hooks 112 and 113 are only hooked on the upper and lower hoops UF and LF, respectively, and the tom-tom T is not fixed to the L-shaped rod LR. Therefore, when the tom-tom T is lifted with hands in order to adjust the height of the tom-tom T, the upper and lower hoops UF and LF are easily detached from the hooks 112 and 113. Therefore, the work for adjusting the height of the tom-tom T is not easy.

Further, since the tom-tom T is not fixed to the L-shaped rod LR, the attitude of the tom-tom T attached on the bass drum is unstable.

SUMMARY OF THE INVENTION

An objective of the present invention is to provide a drum mounting device capable of adjusting the height of the drum easily and stabilizing the attitude of the drum, and a drum.

To achieve the foregoing objective and in accordance with one aspect of the present invention, a drum mounting device for attaching a drum to a mount object on which the drum is mounted is provided. The mount object has a pole to which the drum is attached. The drum mounting device includes a bracket fixed to the drum and a memory lock fixed to the pole at an mounting position of the drum. The bracket is capable of being fixed to the memory lock.

DETAILED DESCRIPTION OF THE PREFERRED EMBODIMENTS

Hereinafter, an embodiment in which a drum mounting device according to the present invention has been embodied as a tom-tom mounting device will be described with reference to FIGS. 1 to 12B.

Figure 1:
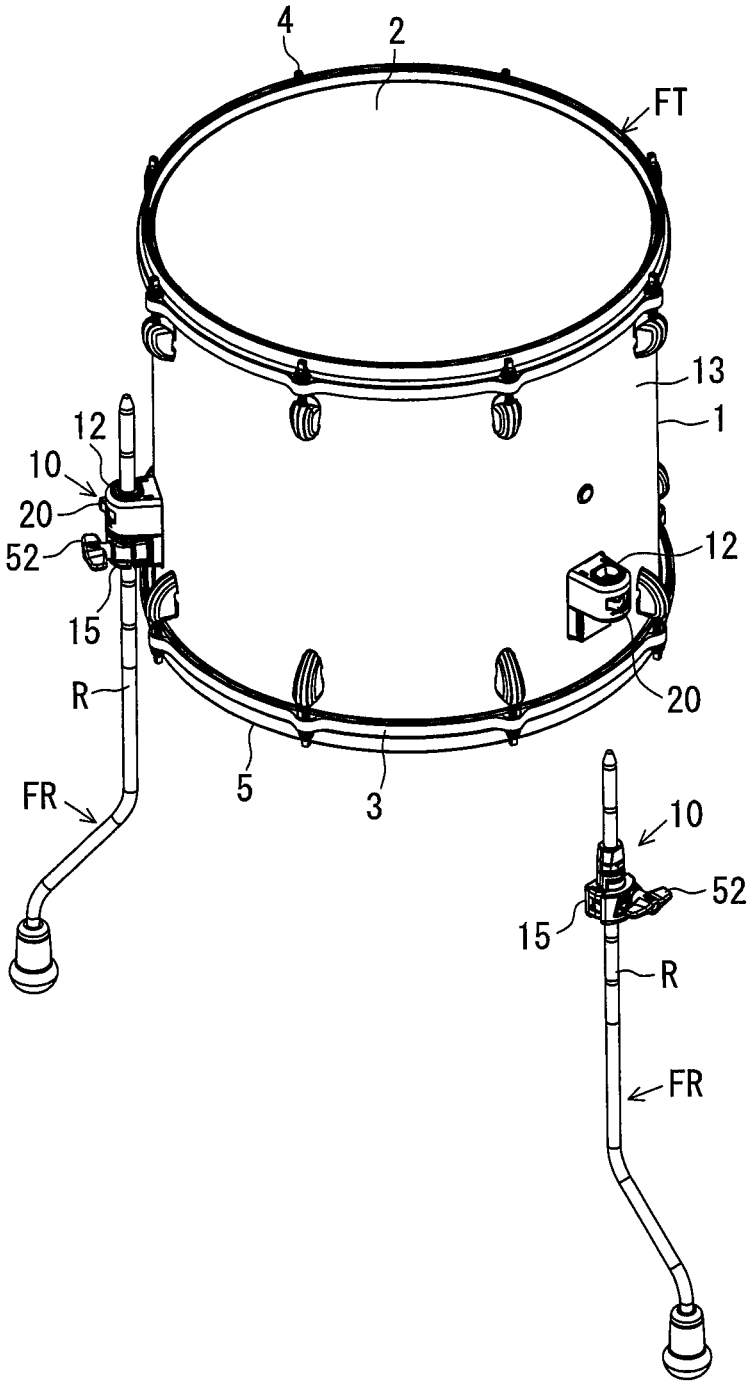
FIG. 1 is a perspective view of a floor tom-tom provided with a tom-tom mounting device according to one embodiment of the present invention, and floor tom-tom legs on which the floor tom-tom is mounted.

As shown in FIG. 1, a floor tom-tom FT is provided with a cylindrical shell 1, a batter head 2, a bottom head 3, an upper hoop 4, and a lower hoop 5. The upper hoop 4 is attached to an upper opening end of the shell 1 together with the batter head 2. The lower hoop 5 is attached to a lower opening end of the shell 1 together with the bottom head 3.

The floor tom-tom FT is attached to three floor tom-tom legs FR serving as mount objects via three tom-tom mounting devices 10, and set up on a floor. Each tom-tom mounting device 10 is composed of a memory lock 15, and a floor tom-tom bracket (hereinafter, referred to as bracket) 12 located on the memory lock 15. The tom-tom mounting device 10 is configured to be capable of fixing the bracket 12 to the memory lock 15.

The memory lock 15 is fixed to a rod R as a pole constituting the floor tom-tom leg FR, or detached from the rod R by operating a wing nut 52. The fixing position of the memory lock 15 in relation to the floor tom-tom leg FR is determined by a player such that the floor tom-tom FT can be set up on a floor at easy-to-play height and angle. On the other hand, the bracket 12 is fixed to an outer peripheral surface of a shell 13 in the vicinity of the lower hoop 5.

Next, the respective configurations of the bracket 12 and the memory lock 15 will be described with reference to FIGS. 2 to 8, 11A, and 11B. To describe the bracket 12 and the memory lock 15, upward, downward, leftward, rightward, frontward, and rearward directions of the bracket 12 and the memory lock 15 are defined as shown in FIGS. 4 and 7.

Figure 2:
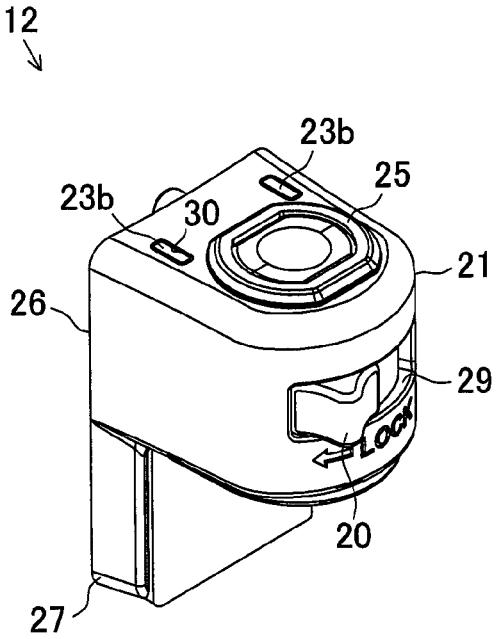
FIG. 2 is a perspective view of a bracket.
Figure 4:
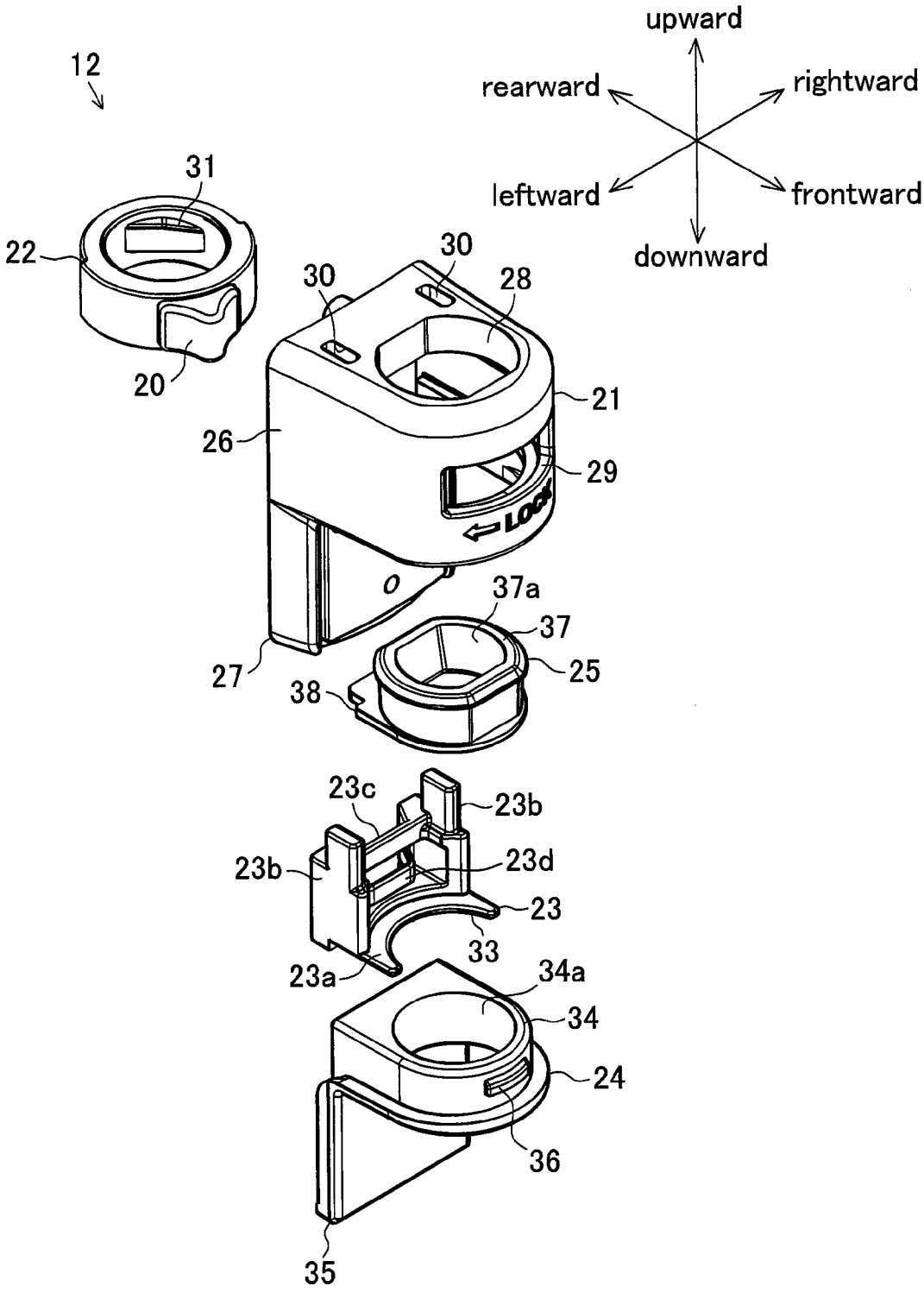
FIG. 4 is an exploded perspective view of the bracket.

As shown in FIGS. 2 and 4, the bracket 12 is provided with a bracket body 21, a lock ring 22 serving as a locking member, a lock stopper 23, a first bushing 24, and a second bushing 25. The bracket body 21 is provided with a substantially box-like upper body portion 26 and a lower body portion 27 extending downward from the upper body portion 26. A substantially circular attachment hole 28 is opened in a center of an upper surface of the upper body portion 26. The attachment hole 28 vertically extends through the upper body portion 26. A laterally-elongated rectangular opening 29 is formed in a front surface of the upper body portion 26. A pair of mounting holes 30 is formed in a rear portion of the upper surface of the upper body portion 26.

Figure 11A:
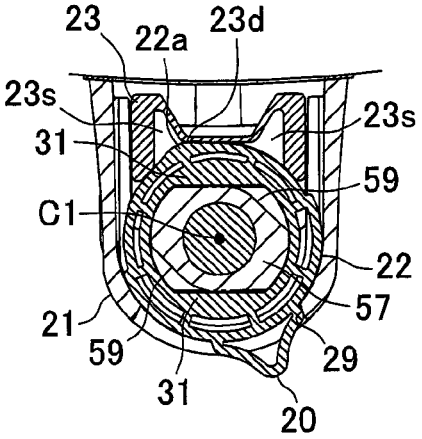
FIG. 11A is a partially cross-sectional plan view showing a positional relationship between a lock ring and a tubular portion when an operating lever is in an unlocking position.
Figure 11B:
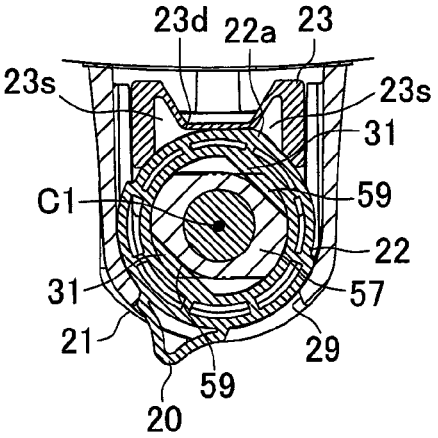
FIG. 11B is a partially cross-sectional plan view showing a positional relationship between the lock ring and the tubular portion when the operating lever is in a locking position.

An operating lever 20, which is operated when fixing the bracket 12 to the memory lock 15, is protruded from an outer peripheral surface of the lock ring 22. As shown in FIGS. 4, 11A, and 11B, a pair of substantially semicircular engaging portions 31 is formed on an inner peripheral surface of the lock ring 22. The respective engaging portions 31 are located in symmetrical positions in relation to an axis of the lock ring 22. Further, a protrusion 22*a* is formed on the outer peripheral surface of the lock ring 22 on the side opposite to the operating lever 20.

The lock stopper 23 is provided with a base portion 23*a*, a pair of mounting pieces 23*b* extending upward from both sides of the base portion 23*a*, and an upper bridge portion 23*c* and a lower bridge portion 23*d* lying between the pair of mounting pieces 23*b*. A cutout portion 33 is formed in the base portion 23*a*. The cutout portion 33 is formed in a semicircular shape concentric with the attachment hole 28 of the upper body portion 26. The lower bridge portion 23*d* is formed in a plate shape, which can be flexed frontward and rearward. Specifically, the lower bridge portion 23*d* is formed in a substantially trapezoidal shape protruded toward the outer peripheral surface of the lock ring 22.

The lock stopper 23 has a substantially triangular space 23S between each of the pair of side walls facing each other and the lower bridge portion 23*d*. When the operating lever 20 is put into the locking position or the unlocking position, the protrusion 22*a* of the lock ring 22 is fitted into either space 23*s* of the lock stopper 23. Further, when the operating lever 20 is turned about an axis C1 to switch between the locking position and the unlocking position, the protrusion 22*a* of the lock ring 22 moves on the surface of the lower bridge portion 23*d*, while causing the lower bridge portion 23*d* to be flexed rearward.

Figure 5:
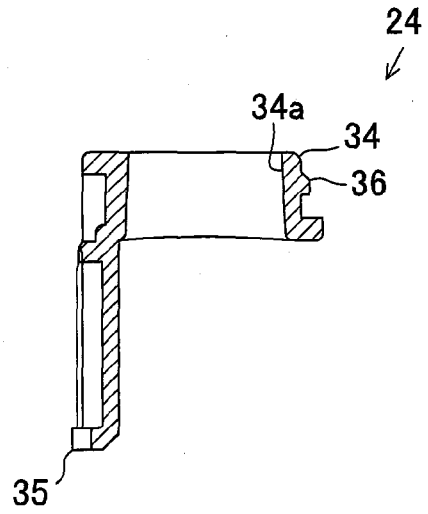
FIG. 5 is a vertical cross-sectional view of a first bushing.

As shown in FIGS. 4 and 5, the first bushing 24 is provided with an annular portion 34 having a circular attachment hole 34*a*, and a flat portion 35 extending downward from a rear portion of the annular portion 34. A protrusion 36 extending laterally is formed at the center of a front surface of the annular portion 34. An inner peripheral surface of the attachment hole 34*a* is tapered such that the inner diameter of the attachment hole 34*a* decreases from a lower end to an upper end of the annular portion 34. The first bushing 24 is formed of an elastic material, such as rubber.

Figure 6A:
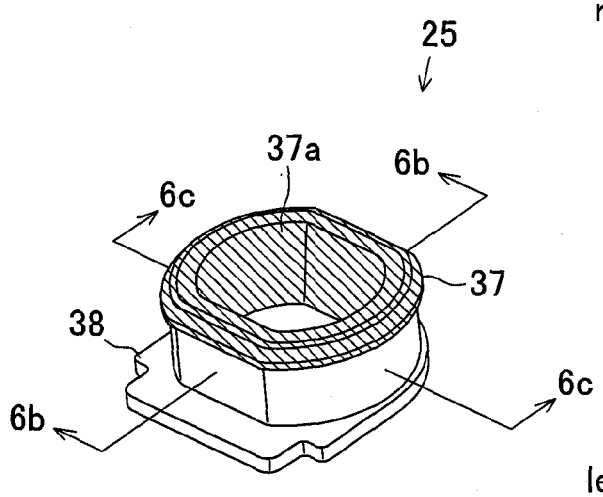
FIG. 6A is a perspective view of a second bushing.
Figure 6B:
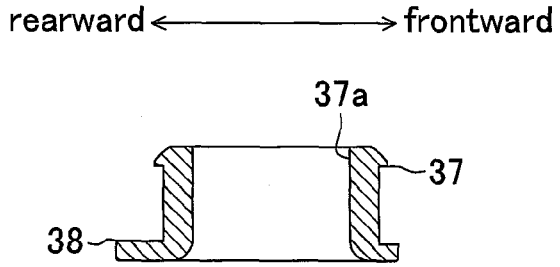
FIG. 6B is a cross-sectional view taken along line 6*b*-6*b of* FIG. 6A.
Figure 6C:
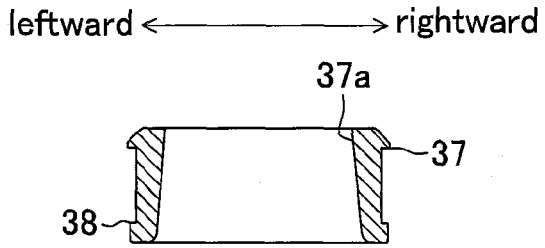
FIG. 6C is a cross-sectional view taken along line 6*c*-6*c* in FIG. 6A.
Figure 7:
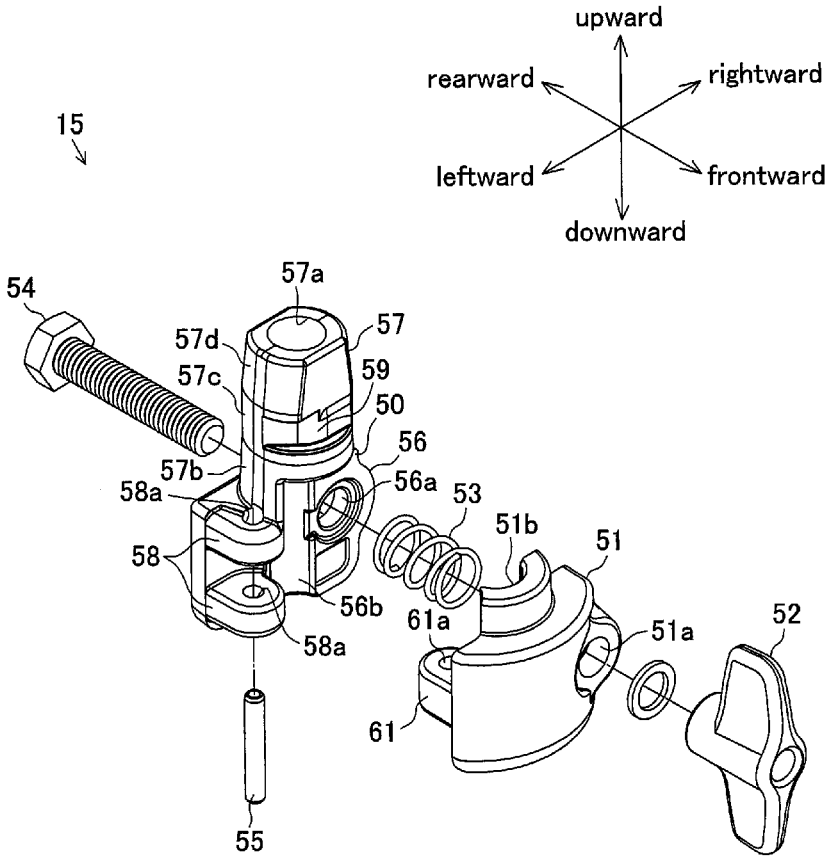
FIG. 7 is an exploded perspective view of the memory lock.

As shown in FIGS. 4 and 6A to 6C, the second bushing 25 is provided with an annular portion 37 having a substantially circular attachment hole 37*a*, and a flange portion 38 located along a lower opening end of the annular portion 37. The outer shape of the annular portion 37 is the same as the shape of the attachment hole 28 of the bracket body 21. On the other hand, the inter shape of the annular portion 37 differs between when viewed in the frontward and rearward direction and when viewed in the leftward and rightward direction shown in FIG. 4. That is, inner peripheral surfaces located in the frontward and rearward directions of the attachment hole 37*a*, as shown in FIG. 6B, are flat surfaces extending parallel to the axis of the attachment hole 37*a*. Inner peripheral surfaces located in the leftward and rightward direction of the attachment hole 37*a*, as shown in FIG. 6C, are tapered such that the inner diameter of the attachment hole 37*a* decreases from a lower end to an upper end of the annular portion 37. The second bushing 25 is also formed of an elastic material, such as rubber, like the first bushing 24.

Figure 8:
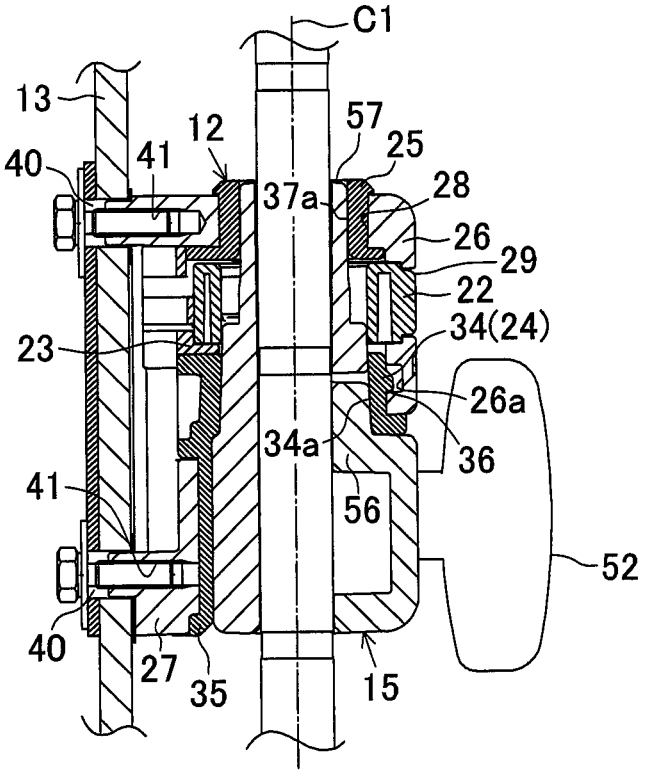
FIG. 8 is a partially cross-sectional view showing a state where the floor tom-tom is fixed to a rod by the tom-tom mounting device.

As shown in FIGS. 2, 4, 8, the lock ring 22, the annular portion 34 of the first bushing 24, the lock stopper 23, and the second bushing 25 are received in the upper body portion 26. The lock ring 22, the annular portion 34 of the first bushing 24, the lock stopper 23, and the second bushing 25 are arranged concentrically with the axis C1 of the attachment hole 28 of the upper body portion 26.

The second bushing 25 is attached to the attachment hole 28 of the upper body portion 26 with an upper opening end of the second bushing 25 exposed to the outside. The lock stopper 23 is attached to a rear portion of the center of the upper body portion 26 with the pair of mounting pieces 23*b* fitted in the mounting holes 30. The first bushing 24 is attached to a lower end of the upper body portion 26 with the protrusion 36 fitted in an inner groove 26*a* of the upper body portion 26 and with the flat portion 35 abutting against the lower body portion 27.

The lock ring 22 is fitted into a space in the upper body portion 26 continuous with the opening 29 from a rear portion of the upper body portion 26. The lock ring 22 is supported by an inner wall of the upper body portion 26 and the lock stopper 23 so as not to move upward and downward. Further, the lock ring 22 is supported so as to be rotational on the axis C1 of the attachment hole 28 in the space in the upper body portion 26. The operating lever 20 is protruded from the opening 29 of the upper body portion 26.

The bracket body 21 has a pair of mounting portions 40, which extends rearward from the upper body portion 26 and the lower body portion 27. An internal thread 41 opening rearward is formed in each mounting portion 40. The bracket 12 is fixed to the shell 13 by fitting the pair of mounting portions 40 into mounting holes of the shell 13 and tightening two bolts in the respective mounting portions 40 from the inside of the shell 13.

Figure 3:
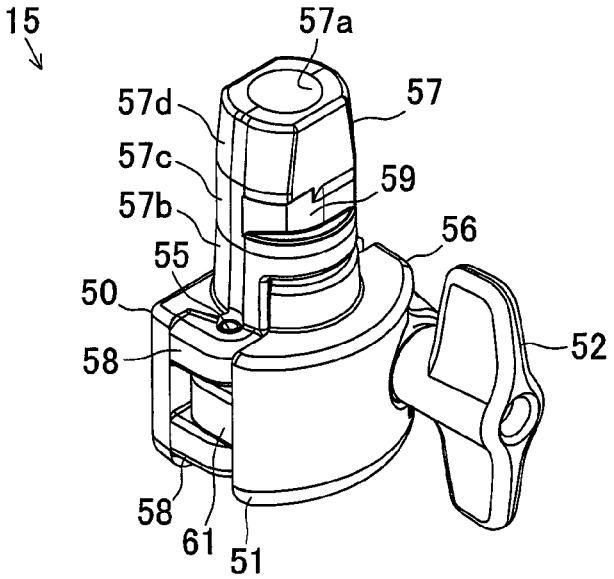
FIG. 3 is a perspective view of a memory lock.

As shown in FIGS. 3 and 7, the memory lock 15 is provided with a holder body 50, a holder cover 51, the wing nut 52, a spring 53, a bolt 54, and a coupling pin 55. The holder body 50 is provided with a base portion 56 having a lateral hole 56*a*, and a tubular portion 57 extending upward from the base portion 56. A recess 56*b* semicircular in cross section is formed inside the base portion 56. A pair of upper and lower mounting portions 58 having vertical holes 58*a* is formed in the base portion 56.

An upper insertion hole 57*a* provided to be continuous with the recess 56*b* and extending along the axis of the tubular portion 57 is formed in the tubular portion 57. The vicinity of a distal end of the tubular portion 57 is formed so as to coincide with the attachment hole 37*a* of the second bushing 25. The tubular portion 57 is provided with a first outer peripheral surface 57*b* extending from a base end to the vicinity of a center of the tubular portion 57, a second outer peripheral surface 57*c* having a constant width in the vicinity of the center, and a third outer peripheral surface 57*d* extending from the vicinity of the center to an upper end of the tubular portion 57. Both the first and third outer peripheral surfaces 57*b*, 57*d* are tapered such that the outer diameter of the tubular portion 57 decreases upward. The second outer peripheral surface 57*c* is formed in a cylindrical shape extending parallel with the axis of the tubular portion 57. In addition, a pair of engagement recesses 59 serving as portions to be engaged and engaged with the engaging portions 31 of the lock ring 22 is formed in the second outer peripheral surface 57*c*. As shown in FIGS. 11A and 11B, the respective engagement recesses 59 are located in symmetrical positions in relation to the axis of the tubular portion 57.

As shown in FIGS. 3 and 7, a recess 51*b* semicircular in cross section and extending from an upper end to a lower end of the holder cover 51 is formed inside the holder cover 51. The recess 51*b* of the holder cover 51, in combination with the recess 56*b* of the base portion 56, forms a lower insertion hole into which the rod R is inserted. The upper insertion hole 57*a* and the lower insertion hole form a continuous insertion hole provided in the memory lock 15 and extending vertically.

The holder cover 51 has a lateral hole 51*a* coinciding with the lateral hole 56*a* of the holder body 50. Further, the holder cover 51 has a mounting piece 61, which has a vertical hole 61*a* and is located between the mounting portions 58 of the holder body 50. The coupling pin 55 is inserted into the vertical holes 58*a* of the mounting portions 58 and the vertical hole 61*a* of the mounting piece 61. The holder cover 51 is coupled to one side (a left side portion) of the holder body 50 via the coupling pin 55.

The spring 53 is located between the holder body 50 and the holder cover 51 in a compressed fashion. The bolt 54 is inserted from behind the holder body 50 into the lateral hole 56*a* of the holder body 50 and the lateral hole 51*a* of the holder cover 51. The bolt 54 is inserted inside the spring 53 between the holder body 50 and the holder cover 51. A distal end of the bolt 54 protrudes frontward from the lateral hole 51*a* of the holder cover 51. The wing nut 52 is screwed on the distal end of the bolt 54 via a washer.

As shown in FIG. 8, in a state where the bracket 12 is fixed to the memory lock 15, the tubular portion 57 is inserted in the attachment hole 28 of the upper body portion 26, and the base portion 56 is located below the upper body portion 26. A rear surface of the base portion 56 abuts against a lower front surface of the bracket 12, namely, the flat portion 35 of the first bushing 24 assembled to the bracket body 21. The tubular portion 57 is inserted in the lock ring 22, the annular portion 34 of the first bushing 24, the lock stopper 23, and the second bushing 25. In addition, the tubular portion 57 is located coaxially with the respective axes of the lock ring 22, the annular portion 34 of the first bushing 24, the lock stopper 23, the second bushing 25, and the attachment hole 28 of the upper body portion 26.

Next, the configuration of the floor tom-tom leg FR will be described with reference to FIGS. 9 to 10B.

Figure 9:
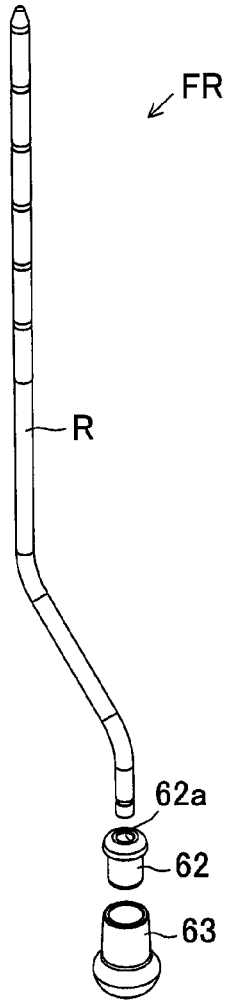
FIG. 9 is an exploded perspective view of a floor tom-tom leg.

As shown in FIG. 9, the floor tom-tom leg FR is provided with the rod R, a first cap 62 attached to a lower end of the rod R, and a second cap 63 attached to a lower portion of the first cap 62. The first cap 62 has a socket 62*a*, into which the lower end of the rod R is inserted. Further, a flange 62*b* is formed around the socket 62*a* on an upper end of the first cap 62. Both the first and second caps 62 and 63 are formed of an elastic material, such as rubber. The hardness of the first cap 62 is set to be higher than the hardness of the second cap 63.

Figure 10A:
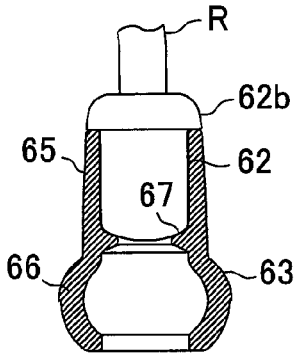
FIG. 10A is a partially cross-sectional view showing a state where a second cap is attached to a first cap with a first tubular portion facing up.
Figure 10B:
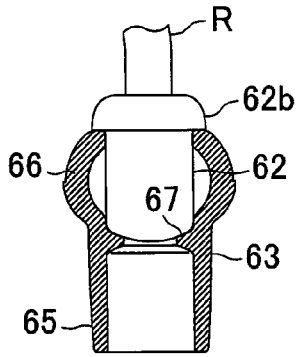
FIG. 10B is a partially cross-sectional view showing a state where the second cap is attached to the first cap with a second tubular portion facing up.

The second cap 63 is provided with a first tubular portion 65 extending along the axis of the second cap 63, and a second tubular portion 66 formed to be swollen outward beyond the first tubular portion 65. The second tubular portion 66 is arranged coaxially with the axis of the first tubular portion 65 and formed integrally with the first tubular portion 65. A protrusion 67 protruding toward the axis of the second cap 63 is formed at a boundary between the first tubular portion 65 and the second tubular portion 66. The protrusion 67 extends annularly along an inner peripheral surface of the second cap 63. Each of opening ends of the first tubular portion 65 and the second tubular portion 66 has the same shape as a lower portion of the first cap 62. Therefore, the second cap 63 is attachable to the first cap 62 with the first tubular portion 65 facing upward, as shown in FIG. 10A, and also attachable to the first cap 62 with the second tubular portion 66 facing upward, as shown in FIG. 10B.

Next, the function of the above tom-tom mounting device 10 will be described with reference to FIGS. 11A to 12B.

Figure 12B:
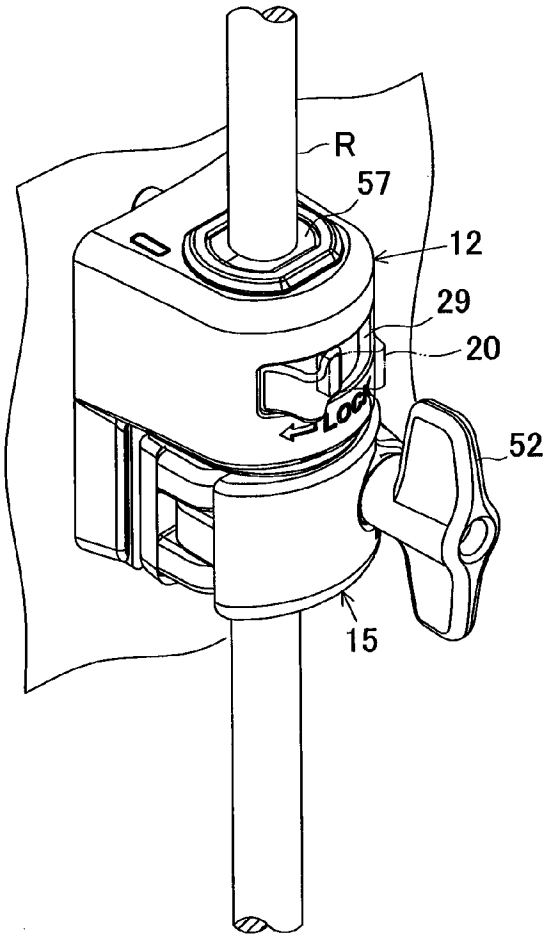
FIG. 12B is a perspective view showing a state where the bracket is fixed to the memory lock.
Figure 12A:
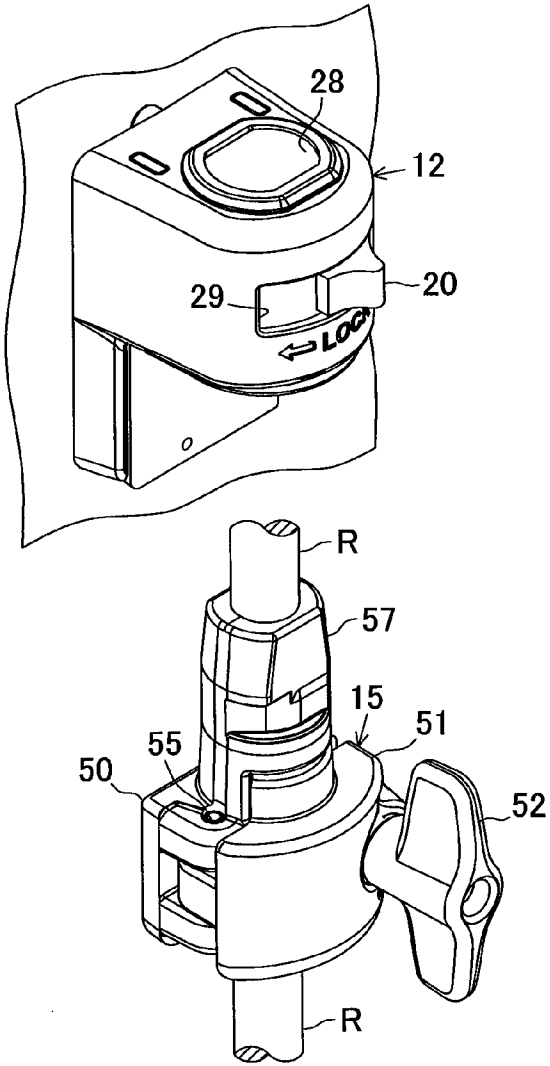
FIG. 12A is a perspective view of the bracket fixed to the floor tom-tom, and the memory lock fixed to the rod.

First, as shown in FIG. 12A, the memory lock 15 is fixed to the rod R of each floor tom-tom leg FR. Specifically, first, the wing nut 52 screwed on the bolt 54 shown in FIG. 7 is loosened. Thereby, by an urging force of the spring 53 shown in FIG. 7, the holder cover 51 turns about the coupling pin 55 and slightly open relative to the holder body 50. In this state, after the rod R is inserted into the insertion hole of the memory lock 15 and moved to a predetermined position, the wing nut 52 screwed on the bolt 54 is tightened.

Next, the bracket 12 is arranged on the memory lock 15. Specifically, as shown in FIG. 12A, first, it is confirmed that the operating lever 20 of the bracket 12 is in the unlocking position. Then, as shown in FIG. 12B, the bracket 12 is assembled to the memory lock 15 by inserting the tubular portion 57 together with the rod R into the attachment hole 28 of the bracket 12. At this time, as shown by lines formed by a long dash alternating with two short dashes in FIG. 12B, the operating lever 20 is in the unlocking position. Therefore, as shown in FIG. 11A, the engaging portions 31 of the lock ring 22 are not engaged with the engagement recesses 59 of the tubular portion 57.

Finally, the bracket 12 is fixed to the memory lock 15. Specifically, by sliding the operating lever 20 leftward, the position of the operating lever 20 is switched to the locking position shown by a solid line in FIG. 12B. The sliding operation of the operating lever 20 turns the lock ring 22 clockwise from a state shown in FIG. 11A, thereby engaging the engaging portions 31 of the lock ring 22 with the engagement recesses 59 of the tubular portion 57 shown in FIG. 11B. Thus, the bracket 12 is fixed to memory lock 15 so as not to separate therefrom. The operations should be performed in the reversed order when detaching the bracket 12 from the memory lock 15.

The above sequence of operations is performed for each of three floor tom-tom legs FR. According to the present embodiment, since the bracket 12 can be fixed to the memory lock 15, by only operating the memory lock 15, the height of the floor tom-tom FT in relation to the three floor tom-tom legs FR can be easily adjusted. Therefore, when the height of the floor tom-tom FT is adjusted, it is unnecessary to remove both the bracket 12 and the memory lock 15 from the rod R. Further, since the bracket 12 is attachable to and detachable from the memory lock 15, the floor tom-tom FT can be easily removed from the three floor tom-tom legs FR. In addition, since the memory lock 15 can be fixed to the bracket 12, the floor tom-tom FT can also be set up on a floor with a stable attitude.

Therefore, according to the present embodiment, the following advantages are obtained.

(1) The tom-tom mounting device 10 is configured such that the bracket 12 can be fixed to the memory lock 15. According to this configuration, since the bracket 12 can be fixed to the memory lock 15, the height of the floor tom-tom FT in relation to the three floor tom-tom legs FR can be easily adjusted by only operating the memory lock 15. That is, since the work of tightening and loosening the bolts becomes less frequent, the work for adjusting the height of the floor tom-tom FT can be reduced. Further, when the memory lock 15 is used with the bracket 12 detached from the memory lock 15, the conventional memory lock function of making the rod R memorize the mounting position of the floor tom-tom FT can be provided. That is, since the mounting position of the floor tom-tom FT is memorized by the memory lock 15, when the floor tom-tom FT after it is stored is used again, it is possible to quickly complete the setting of the floor tom-tom FT. Further, since the floor tom-tom FT can be fixed to the rod R by fixing the bracket 12 to the memory lock 15, the attitude of the floor tom-tom FT attached to the three floor tom-tom legs FR is stable.

(2) The holder body 50 is provided with the tubular portion 57 extending upward from the base portion 56. On the other hand, the bracket body 21 has the attachment hole 28 extending through the upper body portion 26 vertically. Further, in the state where the bracket 12 is fixed to the memory lock 15, the tubular portion 57 is inserted in the attachment hole 28 of the upper body portion 26. According to this configuration, since the tubular portion 57 of the memory lock 15 is inserted into the attachment hole 28 of the bracket 12, the bracket 12 and the memory lock 15 are coaxially arranged. This makes it possible to reduce the size of the tom-tom mounting device 10.

(3) The bracket 12 is provided with the lock ring 22 serving as the locking member. The operating lever 20 is formed on the outer peripheral surface of the lock ring 22. Further, by only operating the operating lever 20 in a sliding manner, the bracket 12 is fixed to the memory lock 15, or the bracket 12 is released from the memory lock 15. Thus, the bracket 12 can be attached to or detached from the memory lock 15 by the easy one-touch operation of the lock ring 22. Therefore, when the floor tom-tom FT is stored, the floor tom-tom FT can be detached easily from each floor tom-tom leg FR. Further, when the floor tom-tom FT is used, the floor tom-tom FT can be easily mounted on each floor tom-tom leg FR. That is, the operability of the tom-tom mounting device 10 is improved.

(4) The lock ring 22 is arranged coaxially with the attachment hole 28 of the upper body portion 26. Further, the tubular portion 57 is inserted in the lock ring 22. According to this configuration, the lock ring 22 can be arranged coaxially with the bracket 12 and the memory lock 15. Therefore, the size of the tom-tom mounting device 10 can be further reduced.

(5) The pair of engaging portions 31 is formed in the inner peripheral surface of the lock ring 22. The pair of engagement recesses 59 engaging with the engaging portions 31 of the lock ring 22 is formed in the outer peripheral surface of the tubular portion 57. By sliding the operating lever 20 from the unlocking position to the locking position, the lock ring 22 in the state shown in FIG. 11A is turned clockwise, and the engaging portions 31 of the lock ring 22 engages with the engagement recesses 59 of the tubular portion 57. According to this configuration, the parts for fixing the bracket 12 to the memory lock 15 are only two parts, that is, the lock ring 22 and the memory lock 15. Therefore, in the manufacture of the tom-tom mounting device 10, the number of parts can be reduced, so that the part costs, the number of assembling steps, and the like are reduced.

(6) As described above, by operating the operating lever 20 to the locking position in a sliding manner, the bracket 12 is fixed to the memory lock 15. On the other hand, by operating the operating lever 20 to the unlocking position in a sliding manner, the bracket 12 is released from a fixing state thereof to the memory lock 15. In this case, according to the sliding operation of the operating lever 20, the lock ring 22 can be turned about the axis C1 of the attachment hole 28. This makes it possible to slide the inner peripheral surface of the lock ring 22 on the second outer peripheral surface 57*c* of the tubular portion 57 formed in a cylindrical shape. Therefore, the turning operation of the lock ring 22 for engaging the engaging portions 31 with the engagement recesses 59 can be performed smoothly without discomfort.

(7) Both the first bushing 24 and the second bushing 25 are formed of an elastic material, such as rubber. According to this configuration, the first bushing 24 and the second bushing 25 can absorb vibrations generated by beating the floor tom-tom FT. Therefore, the vibrations of the floor tom-tom FT are prevented from being transmitted to the floor via the tom-tom mounting device 10 and the floor tom-tom legs FR. This improves the sound quality of the floor tom-tom FT. Further, the vibrations transmitted to a hand of a player beating the floor tom-tom FT can be kept low. This makes the floor tom-tom FT easy to play.

(8) By attaching the second cap 63 to the first cap 62 with the first tubular portion 65 facing upward, a vibration-isolating function provided by the second tubular portion 66 is increased. In this case, by the vibrations generated by beating the floor tom-tom FT, the batter head 2 is likely to shake, but deviation of the setting position of the floor tom-tom FT from an original position thereof can be prevented. Further, the feel of beating the floor tom-tom FT can also be softened. On the other hand, by attaching the second cap 63 to the first cap 62 with the second tubular portion 66 facing upward, a vibration-isolating function provided by the second tubular portion 66 can be suppressed. In this case, the setting position of the floor tom-tom FT easily deviates from the original position, but the batter head 2 can be made hard to shake. Further, the feel of beating the floor tom-tom FT can also be hardened.

(9) Both the inner peripheral surface of the attachment hole 34*a* of the first bushing 24 and the inner peripheral surface of the attachment hole 37*a* of the second bushing 25 are tapered. Also, the first and third outer peripheral surfaces 57*b*, 57*d* of the tubular portion 57 inserted in the attachment holes 34*a* and 37*a* of the first and second bushings 24 and 25, respectively, are tapered. This makes it easier to insert/remove the tubular portion 57 into/from the first and second bushings 24 and 25, so that the bracket 12 can be easily attached to and detached from the memory lock 15.

(10) The rear surface of the base portion 56 abuts against the flat portion 35 of the first bushing 24 assembled to the bracket body 21. This makes it possible to restrict relative rotation of the bracket 12 and the memory lock 15. Therefore, in addition to the conventional memory lock function of making the rod R memorize the mounting position of the floor tom-tom FT, the tom-tom mounting device 10 is provided with a memory lock function of making the rod R memorize the mounting angle of the floor tom-tom FT.

(11) When the operating lever 20 is turned about the axis C1 to be positioned at the locking position or the unlocking position, the protrusion 22*a* of the lock ring 22 moves on the surface of the lower bridge portion 23*d*, while causing the lower bridge portion 23*d* to be flexed rearward. When the operating lever 20 is moved to the locking position or the unlocking position, flexing of the lower bridge portion 23*d* is cancelled, and simultaneously the protrusion 22*a* of the lock ring 22 is fitted into the space 23*s* of the lock stopper 23. At this time, the operator feels a click, and therefore the operator can recognize whether the operating lever 20 has been locked or unlocked. Further, according to this configuration, since the operating lever 20 is not held in a position intermediate between the locking position and the unlocking position, the switching operation of the operating lever 20 to the locking position or the unlocking position can be ensured.

The present embodiment may be modified in the following manner.

Figure 13:
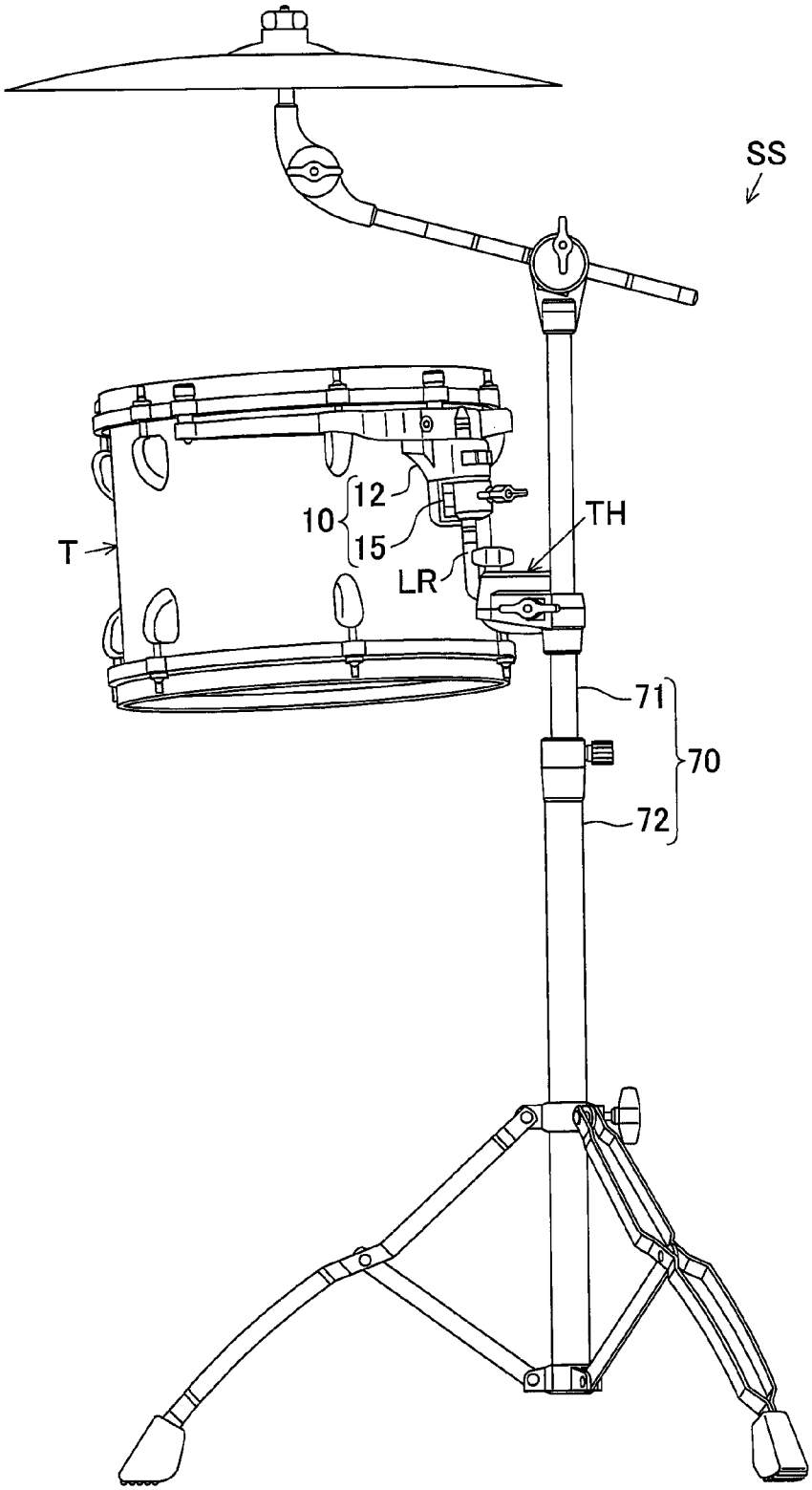
FIG. 13 is a perspective view of a cymbal stand provided with the tom-tom mounting device, and the cymbal stand on which the tom-tom is mounted.
Figure 14:
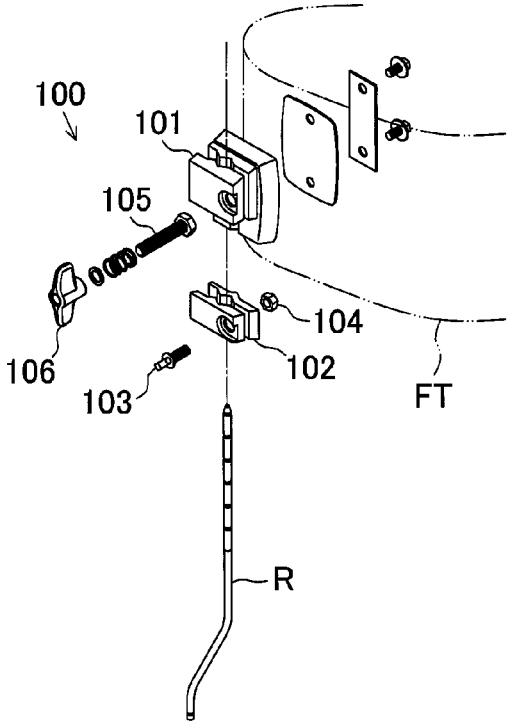
Fig.14 (Prior Art)
FIG. 14 is an exploded perspective view showing a conventional tom-tom mounting device.
Figure 15:
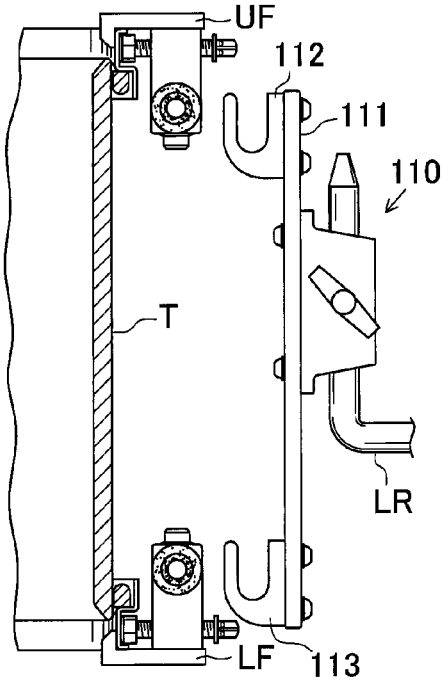
Fig.15 (Prior Art)
FIG. 15 is a partially cross-sectional view showing another conventional tom-tom mounting device.

In the embodiment, the tom-tom mounting device 10 may be used not only in setting up the floor tom-tom FT on the floor tom-tom legs FR, but also in setting up the same on a dedicated tom-tom stand. Further, the tom-tom mounting device 10 may be used in setting up a tom-tom constituting a part of a drum set on a cymbal stand, or in setting up the same on the tom-tom holder fixed to the bass drum. For example, as shown in FIG. 13, in the case of applying the tom-tom mounting device 10 to a cymbal stand SS, the tom-tom T is mounted on the cymbal stand SS serving as a mount object via one tom-tom mounting device 10. The tom-tom mounting device 10 is composed of the memory lock 15 and the bracket 12. The bracket 12 is fixed to the outer peripheral surface of the shell of the tom-tom T. The memory lock 15 is fixed to the L-shaped rod LR protruding from a tom-tom holder TH fixed to the cymbal stand SS. The tom-tom holder TH is fixed to an upper pipe 71 of a pair of upper and lower pipes 71 and 72 constituting a supporting pole 70.

In the present embodiment, a hollow pipe may be used in place of the rod R as the pole. In addition, the cross-sectional shape of the pole may be not only circular, but also polygonal, for example, tetragonal or hexagonal.

In the present embodiment, the tom-tom mounting device 10 is fixed to the rod R extending vertically, but it may be configured to be fixed to the rod R extending laterally.

In the present embodiment, the tubular portion 57 may be omitted from the holder body 50 of the memory lock 15. In this case, by making the inner diameter of the attachment hole 28 of the second bushing 25 to coincide with the outer diameter of the rod R, the rod R fixed to the tom-tom mounting device 10 is prevented from being shaken.

In the present embodiment, at least either one of the first bushing 24 and the second bushing 25 may be omitted from the bracket 12.

In the present embodiment, the first bushing 24 and the second bushing 25 may be formed of an elastic material other than rubber, such as urethane resin or sponge. In addition, the first bushing 24 and the second bushing 25 may be formed of any inelastic material.

In the present embodiment, by engaging the engaging portions 31 of the lock ring 22 with the engagement recesses 59 of the tubular portion 57, the bracket 12 is mechanically fixed to the memory lock 15. However, instead of the engagement recesses 59 having such a pair of upper and lower wall surfaces as shown in FIG. 3, an engagement recess having only an upper surface may be adopted. That is, in order to prevent the lock ring 22 from separating upward from the tubular portion 57, the shape of the engagement recess 59 may be changed accordingly. In addition, instead of such a mechanically-fixing method as described above, for example, magnetic force of a magnet may be used to fix the bracket 12 to the memory lock 15 magnetically.

In the present embodiment, the positional relationship between the engaging portions 31 and the engagement recesses 59 to the lock ring 22 and the tubular portion 57 may be reversed. That is, it is possible to form the engagement recesses 59 in the lock ring 22, and form the engaging portions 31 on the tubular portion 57.

In the present embodiment, as the configuration for attaching and detaching the bracket 12 to and from the memory lock 15, the lock ring 22 is provided with the engaging portions 31 and the tubular portion 57 is provided with the engagement recesses 59. However, the bracket 12 may be attached to and detached from the memory lock 15 using a bolt and a nut.

In the present embodiment, as a locking member for locking the bracket 12 to the memory lock 15, the lock ring 22 operated in a turning manner is adopted. However, for example, a locking member that is slid or pushed to lock the bracket 12 to the memory lock 15 may be adopted. Further, in this case, a locking member having a shape other than a ring-like shape may be adopted.

In the present embodiment, the tom-tom mounting device 10 may be changed to a drum mounting device for attaching a drum other than a tom-tom, for example, a snare drum or the like.

The invention claimed is:

1. A drum mounting device for attaching a drum to a mount object on which the drum is mounted, the mount object having a pole to which the drum is attached, the drum mounting device comprising:

a bracket fixed to the drum, wherein the bracket has a through hole extending through the bracket vertically;

a memory lock fixed to the pole at a mounting position of the drum, wherein the memory lock has a tubular portion extending upward; and a ring-shaped locking member located in the bracket such that the ring-shaped locking member is rotatable about an axis of the through hole in a space of the bracket, wherein the locking member locks the bracket to the memory lock, and the bracket is adapted to be fixed to the memory lock with the tubular portion inserted in the through hole and with an axis of the through hole located coaxially with those of the tubular portion and the locking member.

2. A drum comprising:

a mounting device for attaching the drum to a mount object on which the drum is mounted, the mount object having a pole to which the drum is attached, wherein the mounting device includes:

a bracket fixed to the drum, wherein the bracket has a through hole extending through the bracket vertically;

a memory lock fixed to the pole at a mounting position of the drum, wherein the memory lock has a tubular portion extending upward; and a ring-shaped locking member located in the bracket, and wherein the ring-shaped locking member is rotatable about an axis of the through hole in a space of the bracket, the locking member locks the bracket to the memory lock, and the bracket is adapted to be fixed to the memory lock with the tubular portion inserted in the through hole and with an axis of the through hole located coaxially with those of the tubular portion and the locking member.

3. The drum mounting device according to claim 1, wherein the locking member is ring-shaped and is arranged coaxially with the bracket, and the tubular portion is located in the locking member when the bracket is locked to the memory lock.

4. The drum mounting device according to claim 1, wherein the locking member includes an engaging portion, the memory lock includes a portion to be engaged, which is adapted to engage the engaging portion, and the bracket is fixed to the memory lock by turning the locking member until the engaging portion engages with the portion to be engaged.

5. The drum mounting device according to claim 4, wherein the engaging portion is formed on an inner peripheral surface of the locking member, and the portion to be engaged is located on an outer peripheral surface of the tubular portion.

6. The drum according to claim 2, wherein the memory lock includes a releasable clamp for fixing the memory lock to the pole in an adjustable manner so that the mounting position of the memory lock on the pole is adjustable.

7. The drum mounting device according to claim 1, wherein the memory lock includes a releasable clamp for fixing the memory lock to the pole in an adjustable manner so that the mounting position of the memory lock on the pole is adjustable.

8. The drum according to claim 2, wherein the memory lock is adapted to remain fixed to the pole at the mounting position during a separation of the memory lock from the bracket when the memory lock is unlocked from the bracket.

9. The drum mounting device according to claim 1, wherein the memory lock is adapted to remain fixed to the pole at the mounting position during a separation of the memory lock from the bracket when the memory lock is unlocked from the bracket.

* * * * *